United States Patent [19]

Dias dos Santos

[11] Patent Number: 4,756,250

[45] **Date of Patent: * Jul. 12, 1988**

[54] NON-ELECTRIC AND NON-EXPLOSIVE TIME DELAY FUSE

[75] Inventor: Danilo A. Dias dos Santos, Curitiba, Brazil

[73] Assignee: Britanite Industrias Quimicas Ltda., Parana, Brazil

[ * ] Notice: The portion of the term of this patent subsequent to Apr. 28, 2004 has been disclaimed.

[21] Appl. No.: 860,803

[22] Filed: May 8, 1986

Related U.S. Application Data

[63] Continuation-in-part of Ser. No. 690,879, Jan. 14, 1985.

[51] Int. Cl.[4] ..... C06C 5/00

[52] U.S. Cl. ..... 102/275.1; 102/202.3; 102/275.3; 149/3

[58] Field of Search ..... 102/202.3, 275.1, 275.3; 149/3

[56] References Cited

U.S. PATENT DOCUMENTS 4,290,366 9/1981 Janoski ..... 102/202.3

*Primary Examiner*—Stephen J. Lechert, Jr.

*Attorney, Agent, or Firm*—Kimmel, Crowell & Weaver

[57] ABSTRACT

Non-electric and non-explosive fuse-like initiating device which makes use of a process of propagation of a gaseous plasma generated by deflagration of a pyrotechnic material deposited as a layer on the inner surface of a supporting duct, employing transfer of thermal energy given by an instantaneous source of heat from one end to the other of the duct, for application in the art of blasting with a fuse-like function. The pyrotechnic mixture applied to the supporting duct is subjected to a suitable mixing process to ensure cohesive properties so that the mixture will adhere in the proper manner to the inner surface of the supporting duct and permit great flexibility in the density of the lining charge. Use of a pyrotechnic mixture to line the inner surface of the duct permits the use of a vast range of chemical substances.

The initiating device in terms of the length and type of pyrotechnic mixture used may serve as a non-electric and non-explosive time delay fuse or perform a time delay function in addition to serving as a fuse device.

9 Claims, No Drawings

NON-ELECTRIC AND NON-EXPLOSIVE TIME DELAY FUSE

BACKGROUND OF THE INVENTION

This a continuation-in-part of Ser. No. 690,879, filed Jan. 14, 1985.

Fuses are employed for transmitting the detonation of a blasting cap or of an explosive charge to a second explosive charge at any desired distance. Fuses which have been employed in the past transmit or reinforce a percussion wave through a tube which transfers energy from the application point of the percussion wave, which is usually generated by the detonation of a primary detonator, to the other end of the tube. The percussion wave is utilized to initiate a blasting cap or detonator much like the action of a detonating cord through its high explosive core.

The fuses demonstrated in the prior art present a number of disadvantages. The lining of the inner surface of the prior art tubes is made with a high explosive substance such as pentaerythritol tetranitrate (PETN), carrying, on detonation, nearly instantaneous transfer of energy. Detonation of the high explosive substance deforms the conducting tube as a detonation wave travels along its length. If the conducting tube is flattened or strangled by folding, the detonation wave will be extinguished at the flattened or strangled points. Furthermore, the percussion wave may be extinguished when the conducting tube is punctured, perforated, strangled or constricted sharply in any way by an external agent. The percussion wave may be extinguished when the high explosive lining of the inner surface of the conducting tube has a break in its continuity; is tightly twisted; is stretched significantly by an external agent; is tightly knotted; is spliced by means of a sleeve made of a soft, elastic material such as latex rubber; or when there is a sharp folding or tight curvature of the conducting tube as often happens inside a borehole close to the blasting cap inserted in a cartridge of explosive if there is an accumulation of high explosive material fallen off the lining on the inner surface of the tube. In the latter instance the accumulated high explosive at the bend punctures the tube on detonating, and causes the whole initiating system to fail.

A further difficulty experienced by the use of the fuses of the prior art is the vast uncertainty in velocity of combustion. A typical detonating cord or fuse has a linear velocity of detonation ranging from 6000 to 8000 m/sec. as exemplified in U.S. Pat. Nos. 3,590,739, to Persson, and 4,402,270, to McCaffrey.

SUMMARY OF THE INVENTION

The present invention completely overcomes all the cited disadvantages, since it uses as a support for the material to be deposited any duct which is capable of allowing the adhesion of the pyrotechnic mixtures used with no further concern as to the relationship between the inner and outer diameter, nor to restrictions as to the type of pyrotechnic materials used. Pyrotechnic mixtures are used because they are non-detonating and also because they exhibit far greater reliability in handling and in the mixing processes, permitting thorough homogeneity of the product to be obtained, with no loss of the cohesive properties. For example, the pyrotechnic mixtures used in this invention have deflagration temperatures of about 500° C. with low linear burning velocities of up to 1210 m/sec. This invention uses chemical substances commonly employed in pyrotechnic mixtures in conjunction with other substances to aid in the mixing and/or deflagration process, in order to cause the final mixture to be best suited to the purposes for which it is intended. Pyrotechnic mixtures provide a very wide range of usable substances.

The present invention relates to a non-electric and non-explosive fuse-like initiating device which employs a process of propagation of a gaseous plasma generated by deflagration of a pyrotechnic material deposited as a layer on the inner surface of a duct and more particularly of a tube. This initiating device transfers energy given by an instantaneous source of heat from one end to the other of the duct. More particularly, it relates to the art of blasting by the use of non-electric and non-explosive fuse-like devices, in which pyrotechnic mixtures are employed. The instant invention now provides the art with a technological breakthrough which lowers the priming costs in blasting, widens the range of applicability, reduces the chances of accidental failure and makes available a wide range in the choice of low, controlled burning velocities never heretofore managed in fuse-like percussion, shock or impact wave conductor units which are described in the prior art.

DESCRIPTION OF THE INVENTION

The non-electric and non-explosive fuse-like initiating device or non-electric and non-explosive time delay fuse which is utilized in the instant invention consists of a hollow tube which is internally coated with pyrotechnic mixtures so as to leave a central open conduit.

The hollow tube or support duct may be constructed of any suitable material preferably material which remains intact, that is unruptured and undeformed during the conduction of the gaseous plasma. Typical materials include but are not limited to polyvinyl chloride, polyolefins, rubber or any other similar materials. Rigid materials such as glass or ceramics can also be utilized. The hollow tube or duct can be of any cross-sectional shape provided that the internal cross-section has an area in the range of about 0.19 to about 78.50 $mm^2$, which includes a circular tube having an internal diameter in the range from 0.5 mm to 10 mm.

The use of different pyrotechnic mixtures affords a variation in the velocity of propagation of the gaseous plasma generated by the deflagration of the pyrotechnic mixtures lining the supporting duct. The velocity of propagation essentially depends on the pyrotechnic mixtures employed and on the homogeneity of the mixture as it is almost independent of the amount used to line the internal surface of the tube conductor. The thickness of the pyrotechnic coating layer is of fundamental importance for the maintenance of the plasma in the duct as it is preferred to utilize pyrotechnic lining charges having a density ranging between $1\times10^{-2}$ g/cm$^2$ and $4\times10^{-5}$ g/cm$^2$.

Any suitable pyrotechnic mixtures can be utilized in the instant invention. The velocity of deflagration of the pyrotechnic materials, the fuse-like initiating device of the present invention, is dependent upon the selection of pyrotechnic materials. Determining the velocity of deflagration of the pyrotechnic materials in the fuse-like initiating device enables one to utilize it as a timing device, e.g. a time delay fuse, which has an ample range of available choices of burning speeds and thermal wave conductions or plasmas. It has been determined that the linear velocity of the burning speed of pyrotechnic mixtures ranges from about 500 to about 1210 meters/-sec.

It is also possible to utilize different pyrotechnic mixture having different burning velocities in distinct segments of the fuse devices of the instant invention so that the slower burning pyrotechnic mixtures constitutes a retarder unit or a delaying timer type fuse segment.

Pyrotechnic mixtures generate large amounts of gas and heat in their combustion reaction, a fact which is used in the present invention to enable a plasma to be propagated and maintained within the duct. Gas-generating substances can be used to reinforce the plasma being propagated within the duct. This plasma can be generated by any means which produces large amounts of heat sustained for a short period of time. Typically a blasting cap is utilized to initiate the plasma in the tube. Energy is transferred from point of application to receiving detonator by transferring the heat carried by the gaseous plasma to the priming charge of this detonator. The fuse devices of the instant invention are irresponsive to static electricity, parasitic currents, direct flame and impact regardless of the pyrotechnic mixture which is utilized.

Pyrotechnic materials are comprised of fuels, oxidizers and binders. Typical fuels include but are not limited to: powders such as magnesium, aluminum, silicon, boron, zirconium, titanium, manganese, molybdenum, tungsten, lead, selenium as well as alloys or combinations thereof. Oxidizers include but are not limited to: salts that yield oxygen upon decomposition such as sodium nitrate, potassium nitrate, barium nitrate, potassium chlorate, calcium sulfate and the like; oxides such as barium chromate, iron oxide ($Fe_3O_4$), potassium bichromate and the like; and oxygen free elements such as sulfur, and halogenated compounds such as fluorocarbon polymers. Binders which can be utilized include but are not limited to dextrins, gums, and polymer solutions.

The substances chosen to obtain pyrotechnic mixtures must undergo a suitable mixing process which, depending on the substances used, will be in a liquid, solid or pasty medium, so the final mixtures will be obtained without loss of the cohesive properties that are required for the purposes of this invention, that is the pyrotechnic mixture in final form must adhere to the inner surface of the hollow tube or support duct.

The experiments listed ahead are intended to better clarify the scope of the invention and must not be construed as limiting the same:

EXAMPLE 1

A pyrotechnic mixture was conveniently prepared by mixing together powdered aluminum ($d=2.7$ g/cm$^3$), potassium bichromate ($d=2.69$ g/cm$^3$) and ammoniated iron sulphate ($d=1.86$ g/cm$^3$) in the presence of sufficient ethyl alcohol to obtain two distinct solid-liquid phases. The mixture was prepared at room temperature until about 2% of the solvent remained. The mixture was deposited by blowing into the interior of PVC-crystal tubes, one with 3-mm inner diameter and the other with 8-mm inner diameter.

Each tube exhibited a surface density of about $2.3\times10^{-4}$ g/cm$^2$, which corresponds respectively to a charge density of 21.7 mg/m and 57.8 mg/m. Both tubes having been fired by No. 8 blasting caps, the following deflagration velocities were recorded: 1000 m/s for the one with the smaller diameter and 1020 m/s for the one with the larger diameter.

COMPARATIVE EXAMPLE 1A

A powdered aluminum and potassium bichromate pyrotechnic mixture was prepared in the same manner as for the previous example, and was deposited in the interior of a PVC tube with 8-mm inner diameter, so as to exhibit a charge density of 6 mg/m, which corresponds to only $2.39\times10^{-5}$ g/cm$^2$. The gaseous plasma obtained by deflagration of the pyrotechnic mixtures in the tube lacked capability to sustain itself.

EXAMPLE 2

A potassium bichromate, aluminum and ordinary sugar pyrotechnic mixture was prepared in the presence of just enough acetone to produce a thoroughly blended paste which was then caused to dry out.

The pyrotechnic mixture was deposited on the inside of a PVC tube with 1.5-mm inner diameter, so as to exhibit a surface charge of $2.1\times10^{-4}$ g/cm$^2$, which corresponds to 10 mg/m. The gaseous plasma obtained by deflagration of the pyrotechnic mixture conducting device thus prepared was fired with the aid of a No. 8 blasting cap and recorded a deflagration velocity of 1200 m/s.

EXAMPLE 3

The same mixture as prepared in Example 2 was deposited on the inside surface of another tube with the same diameter, but this time with a charge density of $3.57\times10^{-4}$ g/cm2, which corresponds to 17 mg per linear meter of tube.

Deflagration of this pyrotechnic mixtures in this tube recorded a velocity of 1180 m/s.

EXAMPLE 4

A pyrotechnic mixture was conveniently prepared, made up of lead oxide, zirconium, vanadium pentoxide, silicon and morphous boron. This mixture was made to suit the purpose of the invention by successive mixing processes in which liquid, pasty and solid mediums were employed in order to obtain the required cohesion. The pyrotechnic mixture thus prepared was carefully deposited on the inside surface of a high-density polyethylene tube with a 2-mm inner diameter, so as to receive a surface charge density $2.3\times10^{-4}$ g/cm$^2$, which corresponds to 14.4 charge density of $2.3\times10^{-4}$ g/cm$^2$, mg/m.

A tube lined on the inner surface with a pyrotechnic mixture was set up as in Example 2 and was joined to the above mentioned tube by way of a rubber sleeve, thus forming a single concentric tube lined with two different types of pyrotechnic mixtures, having two different inner diameters, the two joined sections being made of two different materials. The joined supporting duct thus arranged recorded a velocity of deflagration of 820 m/s in the unit made from high-density polyethylene tube, and of 1210 m/s in the conductor unit built as per Example 2.

EXAMPLE 5

A gaseous plasma was obtained by deflagration of the pyrotechnic mixtures inner surface lining of a unit made by using a support duct a latex tube with an approximately 1.8-mm inner diameter. As the pyrotechnic mixture to be deposited on the inside, a composition was used containing metallic aluminum, potassium permanganate, lead oxide and ordinary sugar, conveniently blended and deposited on the inside surface of the tube with a surface charge density of $2\times10^{-4}$ g/cm$^2$, which corresponds to a charge of 11.3 mg per meter of duct. A filament of a nickelchromium alloy with a very low ohmic resistance was coupled to one of the extremities. A voltage of 110 V, provided by a 30-A AC power source, was applied to the filament. The power source, upon being operated, generated the plasma and caused it to propagate inside the latex tube, in such a was as to pierce burn a piece of paper 90 g/m$^2$ suitably coupled to the end opposite to the one from which the plasma was started.

EXAMPLE 6

A pyrotechnic mixtures conductor unit was built exactly as described in previous Example 5, by cutting it into three sections of approximately one meter length, on which the following experiments were performed.

The flame of a Bunsen burner was applied to one extremity of the first section and was allowed to penetrate slowly into the entire inner length of the pyrotechnic mixtures conductor unit. No sign of combustion of deflagration was observed in the pyrotechnic composition on the inside of the tube.

The second unit was placed on top of a steel plate and a 2-kilo weight was allowed to drop from a height of four meters on a portion of the duct. No explosion occurred, and the unit was merely dented and ruptured at the points of impact.

The third and last unit proved to be capable of being fired by a blasting cap with less than 0.1 g of PETN charge.

EXAMPLE 7

A small amount of the pyrotechnic mixture used for Examples 3 and 4 was placed on a short length of ring-shaped platinum wire, as is commonly used in laboratories for identifying chemical elements by flame tests. When the pyrotechnic mixture was slowly approached by the flame of a Bunsen burner, it was deflagrated with a flash and some noise, considering the small amount of pyrotechnic material used for the test.

What is claimed is:

1. A non-electric and non-explosive time delay fuse comprising a duct having an inner surface coated with a layer of a deflagratable pyrotechnic material comprised of a fuel, an oxidizer and a binder whereby deflagration of the pyrotechnic material generates a plasma to transfer thermal energy from one end of the duct to the other wherein the duct has an internal cross-sectional area ranging from about 0.19 to about 78.50 mm$^2$.

2. The non-electric and non-explosive time delay fuse as recited in claim 2 wherein the inner surface of the duct when cylindrical has an inner diameter between 0.5 and 10 mm.

3. The non-electric and non-explosive time delay fuse as recited in claim 1 wherein the deflagratable pyrotechnic material on the inner surface of the duct is present in an amount ranging between $1\times10^{-2}$ g/cm$^2$ and $4\times10^{-5}$ g/cm2.

4. The non-electric and non-explosive time delay fuse as recited in claim 1 wherein the velocity of the deflagration of the pyrotechnic ranges between 500 meters per second and 1210 meters per second.

5. The non-electric and non-explosive time delay fuse as recited in claim 1 wherein the fuse contains duct segments containing pyrotechnic mixtures with slower burning speeds which constitute retarder units.

6. The non-electric and non-explosive time delay fuse as recited in claim 1 wherein the duct remains unruptured or undeformed during deflagration of the pyrotechnic material.

7. The non-electric and non-explosive time delay fuse as recited in claim 1 wherein the fuel is selected from the group consisting of magnesium, aluminum, silicon, boron, zirconium, titanium, manganese, molybdenum, tungsten, lead, selenium or alloys or combinations thereof.

8. The non-electric and non-explosive time delay fuse as recited in claim 1 wherein the oxidizer is selected from the group consisting of sodium nitrate, potassium nitrate, barium nitrate, potassium chlorate, calcium sulfate, barium chromate, iron oxide, potassium bichromate, sulfur, and halogenated compounds.

9. The non-electric and non-explosive time delay fuse as recited in claim 1 wherein the binder is selected from the group consisting of dextrins, gums, and polymer solutions.

* * * * *